US011736886B2

(12) United States Patent
Franco et al.

(10) Patent No.: US 11,736,886 B2
(45) Date of Patent: Aug. 22, 2023

(54) IMMERSIVE SOUND REPRODUCTION USING MULTIPLE TRANSDUCERS

(71) Applicant: HARMAN INTERNATIONAL INDUSTRIES, INCORPORATED, Stamford, CT (US)

(72) Inventors: Alfredo Fernandez Franco, Sherman Oaks, CA (US); Jason Riggs, Northridge, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 17/397,250

(22) Filed: Aug. 9, 2021

(65) Prior Publication Data

US 2023/0042762 A1 Feb. 9, 2023

(51) Int. Cl.
*H04R 3/12* (2006.01)
*H04S 7/00* (2006.01)

(52) U.S. Cl.
CPC ..... *H04S 7/303* (2013.01); *H04R 3/12* (2013.01); *H04S 2400/01* (2013.01); *H04S 2400/11* (2013.01); *H04S 2420/01* (2013.01)

(58) Field of Classification Search
CPC .. H04S 7/303; H04S 2400/01; H04S 2400/11; H04S 2430/01; H04R 3/12
See application file for complete search history.

(56) References Cited

U.S. PATENT DOCUMENTS

2002/0057806 A1 5/2002 Hasebe
2009/0043591 A1* 2/2009 Breebaart ..... G10L 19/008 704/500
2018/0332421 A1* 11/2018 Torres ..... H04S 3/008
2021/0168548 A1* 6/2021 Honma ..... H04S 3/002
2022/0167109 A1* 5/2022 Giron ..... H04S 7/303

FOREIGN PATENT DOCUMENTS

WO 2021/021682 A1 2/2021

OTHER PUBLICATIONS

Pulkki, Ville, "Virtual Sound Source Positioning Using Vector Base Amplitude Panning", Journal of the Audio Engineering Society, Audio Engineering Society, vol. 45, No. 6, Jun. 1, 1997, pp. 456-466.

* cited by examiner

*Primary Examiner* — Ping Lee
(74) *Attorney, Agent, or Firm* — Artegis Law Group, LLP

(57) ABSTRACT

One or more embodiments include techniques for generating immersive audio for an acoustic system. The techniques include determining an apparent location associated with a portion of audio; calculating, for each speaker included in a plurality of speakers of the acoustic system, a perceptual distance between the speaker and the apparent location; selecting a subset of speakers included in the plurality of speakers based on the perceptual distances between the plurality of speakers and the apparent location; generating a set of filters based on the subset of speakers and one or more target characteristics of the acoustic system; and generating, for each speaker included in the subset of speakers, a speaker signal using one or more filters included in the set of filters.

20 Claims, 9 Drawing Sheets

IMMERSIVE SOUND REPRODUCTION USING MULTIPLE TRANSDUCERS

BACKGROUND

Field of the Various Embodiments

Embodiments of the present disclosure relate generally to audio processing systems and, more specifically, to techniques for immersive sound reproduction using multiple transducers.

Description of the Related Art

Commercial entertainment systems, such as audio/video systems implemented in movie theaters, advanced home theaters, music venues, and/or the like, provide increasingly immersive experiences that include high-resolution video and multi-channel audio soundtracks. For example, movie theater systems commonly enable multiple, distinct audio channels that are transmitted to separate speakers placed on multiple different sides of the listeners, e.g. in front, behind, to each side, above, and below. As a result, listeners experience a full three-dimensional (3D) sound field that surrounds the listeners on all sides.

Listeners may also want to experience immersive 3D sound fields when listening to audio via non-commercial audio systems. Some advanced home audio equipment, such as headphones and headsets, implement head-related transfer functions (HRTFs) that reproduce sounds in a manner that a listener interprets as being located at specific locations around the listener. HRTF and other similar technologies therefore provide an immersive listening experience when listening to audio on supported systems.

However, some audio systems are unable to provide a similarly immersive listening experience. For example, the speakers included in an automobile typically have poor sound imaging and lack the capabilities to reproduce sounds in an immersive manner. Furthermore, even with systems that can implement HRTF, other listeners and objects around the listeners can block or alter the sounds emitted by the speakers of an audio system. For example, in an automobile, sounds from speakers can be blocked or diminished by seat backs, headrests, and the listeners' heads. Additionally, the sounds emitted by different speakers can also interfere with each other. This interference is referred to herein as "crosstalk." Due to the interference caused by people, objects, and/or crosstalk, a listener may not accurately perceive the sounds produced by the audio system as being located at the desired locations, and the sound may also be distorted or otherwise reduced in quality. Additionally, if the listener moves and/or turns their head in other directions, then the listener may also not accurately perceive the sounds produced by the audio system as being located at the desired locations.

As the foregoing illustrates, what is needed in the art are more effective techniques for generating immersive audio for speaker systems.

SUMMARY

Various embodiments of the present disclosure set forth a computer-implemented method for generating immersive audio for an acoustic system. The method includes determining an apparent location associated with a portion of audio; calculating, for each speaker included in a plurality of speakers of the acoustic system, a perceptual distance between the speaker and the apparent location; selecting a subset of speakers included in the plurality of speakers based on the perceptual distances between the plurality of speakers and the apparent location; generating a set of filters based on the subset of speakers and one or more target characteristics of the acoustic system; and generating, for each speaker included in the subset of speakers, a speaker signal using one or more filters included in the set of filters.

Other embodiments include, without limitation, a system that implements one or more aspects of the disclosed techniques, and one or more computer readable media including instructions for performing one or more aspects of the disclosed techniques.

At least one technical advantage of the disclosed techniques relative to the prior art is that the audio system creates a three-dimensional sound experience while reducing crosstalk and other interference caused by people and/or objects within the listening environment. Furthermore, the audio system is able to adjust the three-dimensional sound experience based on the position and/or orientation of the listener, to account for changes it the position and/or orientation of the listener. Accordingly, the audio system generates a more immersive and accurate sound relative to prior approaches. These technical advantages provide one or more technological advancements over prior art approaches.

BRIEF DESCRIPTION OF THE DRAWINGS

So that the manner in which the above recited features of the various embodiments can be understood in detail, a more particular description of the inventive concepts, briefly summarized above, may be had by reference to various embodiments, some of which are illustrated in the appended drawings. It is to be noted, however, that the appended drawings illustrate only typical embodiments of the inventive concepts and are therefore not to be considered limiting of scope in any way, and that there are other equally effective embodiments.

DETAILED DESCRIPTION

In the following description, numerous specific details are set forth to provide a more thorough understanding of the various embodiments. However, it will be apparent to one of skilled in the art that the inventive concepts may be practiced without one or more of these specific details.

Figure 1A:
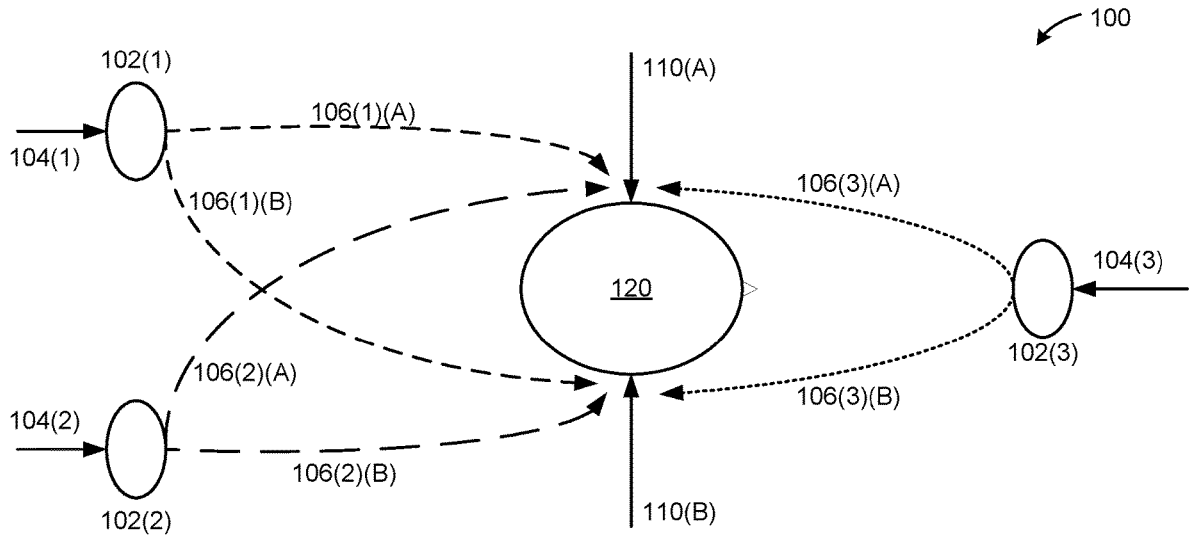
FIGS. 1A and 1B illustrate a listener listening to audio via an acoustic system, according to various embodiments.
Figure 1B:
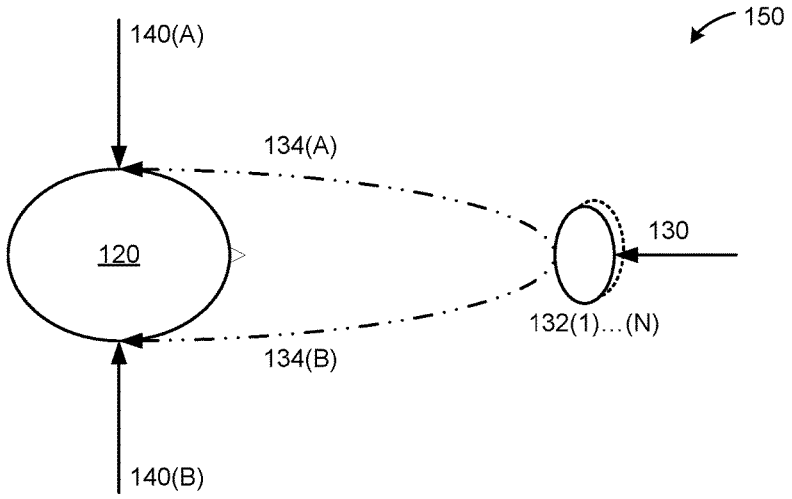

FIGS. 1A and 1B illustrate a listener 120 listening to audio via an acoustic system 100, according to various embodiments. As shown in FIG. 1A, acoustic system 100 includes speakers 102(1), 102(2), and 102(3). Each speaker 102 receives a speaker signal 104 and emits sound waves 106. Speaker 102(1) receives speaker signal 104(1) and emits sound waves 106(1)(A) and 106(1)(B). Speaker 102(2) receives speaker signal 104(2) and emits sound waves 106(2)(A) and 106(2)(B). Speaker 102(3) receives speaker signal 104(3) and emits sound waves 106(3)(A) and 106(3)(B).

The speakers 102(1), 102(2), and 102(3) are positioned at different locations within a listening environment around the listener 120. As shown in FIG. 1A, the listener 120 is positioned in the center of the speakers 102. The listener 120 is oriented facing speaker 102(3), such that speaker 102(3) is positioned in front of the listener 120 and speakers 102(1) and 102(2) are positioned behind the listener 120.

The sound waves 106 emitted by the speakers 102 reach the ears of listener 120 as perceived sound signals 110(A) and 110(B). As shown in FIG. 1A, perceived sound signal 110(A) includes a combination of sound waves 106(1)(A), 106(2)(A), and 106(3)(A). Perceived sound signal 110(B) includes a combination of 106(1)(B), 106(2)(B), and 106(3)(B). Perceived sound signal 110(A) is received at the left ear of listener 120, and perceived sound signal 110(B) is received at the right ear of listener 120.

To produce an immersive sound experience, each speaker 102 could receive a different speaker signal 104 to emit a different sound wave 106. For example, speaker 102(1) could receive a speaker signal 104(1) that corresponds to a sound that is intended for the left ear of the listener, while speaker 102(2) could receive a speaker signal 104(2) that corresponds to a sound intended for the right ear of the listener. An example equation representing acoustic system 100 is given by equation (1):

$$w=v\cdot C \tag{1}$$

In equation (1), w represents the audio signals received at the ears of the listener 120 (e.g., perceived sound signals 110(A) and 110(B)), v represents the input audio signals provided to the speakers 102 (e.g., speaker signals 104(1)-(3)), and C represents the acoustic system 100 including the transmission paths from the speakers 102 to the ears of the listener 120 (e.g., the paths of the sound waves 106).

However, the sound waves 106(1) emitted by speaker 102(1) are received at both the left ear of the listener (sound wave 106(1)(A)) and the right ear of the listener (sound wave 106(1)(B)). Similarly, the sound waves 106(2) emitted by speaker 102(2) are received at both the left ear of the listener (sound wave 106(2)(A)) and the right ear of the listener (sound wave 106(2)(B)).

FIG. 1B illustrates the listener 120 listening to audio via a target acoustic system 150. As shown in FIG. 1B, the target acoustic system 150 includes a plurality of speakers, speakers 132(1)-(N). The plurality of speakers 132(1)-(N) may be located at different positions within a listening environment, similar to that illustrated above with respect to the speakers 102 in FIG. 1A. Target acoustic system 150 receives an input audio signal 130 and emits sound waves 134(A) and 134(B). Sound waves 134(A) and 134(B) generally represent sound waves emitted by one or more speakers of the plurality of speakers 132(1)-(N).

A goal of the target acoustic system 150 is to render the input audio signal 130 in a manner such that the sound waves 134(A) and 134(B) reach the ears of listener 120 as target perceived audio signals 140(A) and 140(B). Target perceived audio signals 140(A) and 140(B) represent the target sound to be heard by the left and right ear, respectively, of the listener 120. As an example, the target sound could be a sound that is perceived by listener 120 as being located at a target position in the listening environment, with minimal crosstalk or other audio interference. In order to successfully produce the target perceived audio signals 140(A) and 140(B), target acoustic system 150 generates sound waves 134(A) and 134(B) that have a set of target characteristics. The target characteristics could include, for example, cross talk cancellation, a HRTF (head-related transfer function) position, or a BRIR (binaural room impulse response) position. An example equation representing the target acoustic system 150 is given by equation (2):

$$d=a\cdot u \tag{2}$$

In equation (2), d represents the desired audio signals to be received at the ears of a listener (e.g., target perceived sound signals 140(A) and 140(B)), u represents the input audio signals to be processed (e.g., input audio signal 130), and a represents desired target characteristics (e.g., of sound waves 134(A) and 134(B)). Example equations representing target characteristics are given by equations (3A)-(3C).

$$a_1=\delta(n), a_2=0 \tag{3A}$$

$$a_1=\mathrm{HRTF}_L(\mathrm{pos}), a_2=\mathrm{HRTF}_R(\mathrm{pos}) \tag{3B}$$

$$a_1=\mathrm{BRIR}_L(\mathrm{pos}), a_2=\mathrm{BRIR}_R(\mathrm{pos}) \tag{3C}$$

In equations (3A)-(3C), $a_1$ represents the target characteristics for the sound waves targeting the left side of the listener 120 (e.g., sound waves 134(A)) and $a_2$ represents the target characteristics for the sound waves targeting the right side of the listener 120 (e.g., sound waves 134(B)). As shown, equation (3A) represents a target characteristic for crosstalk cancellation and equations (3B) and (3C) represent target characteristics for binaural sound positioning.

To generate a set of desired audio signals, e.g., target perceived sound signals 140(A) and 140(B), using a given acoustic system, e.g., acoustic system 100, a set of filters are applied to the input audio signal 130. The specific set of filters can vary depending on the target characteristics as well as the properties of the acoustic system. An example equation for obtaining desired audio signals from an acoustic system is given by equation (4):

$$d=((h\cdot C)\cdot a)\cdot u \tag{4}$$

As shown in equation (4), h represents the set of filters, C represents the acoustic system (e.g., acoustic system 100), u represents the input audio signals to be processed, and a represents desired target characteristics, such as those represented by equations (3A)-(3C) above.

In practice, if the acoustic system is not optimally configured, the dynamic range of the acoustic system is reduced. Accordingly, as described in further detail below, an optimal subset of speakers is selected from the set of speakers included in the acoustic system for rendering the desired audio signals to be received at the ears of a listener, such as target perceived sound signals 140(A) and 140(B).

Figure 2:
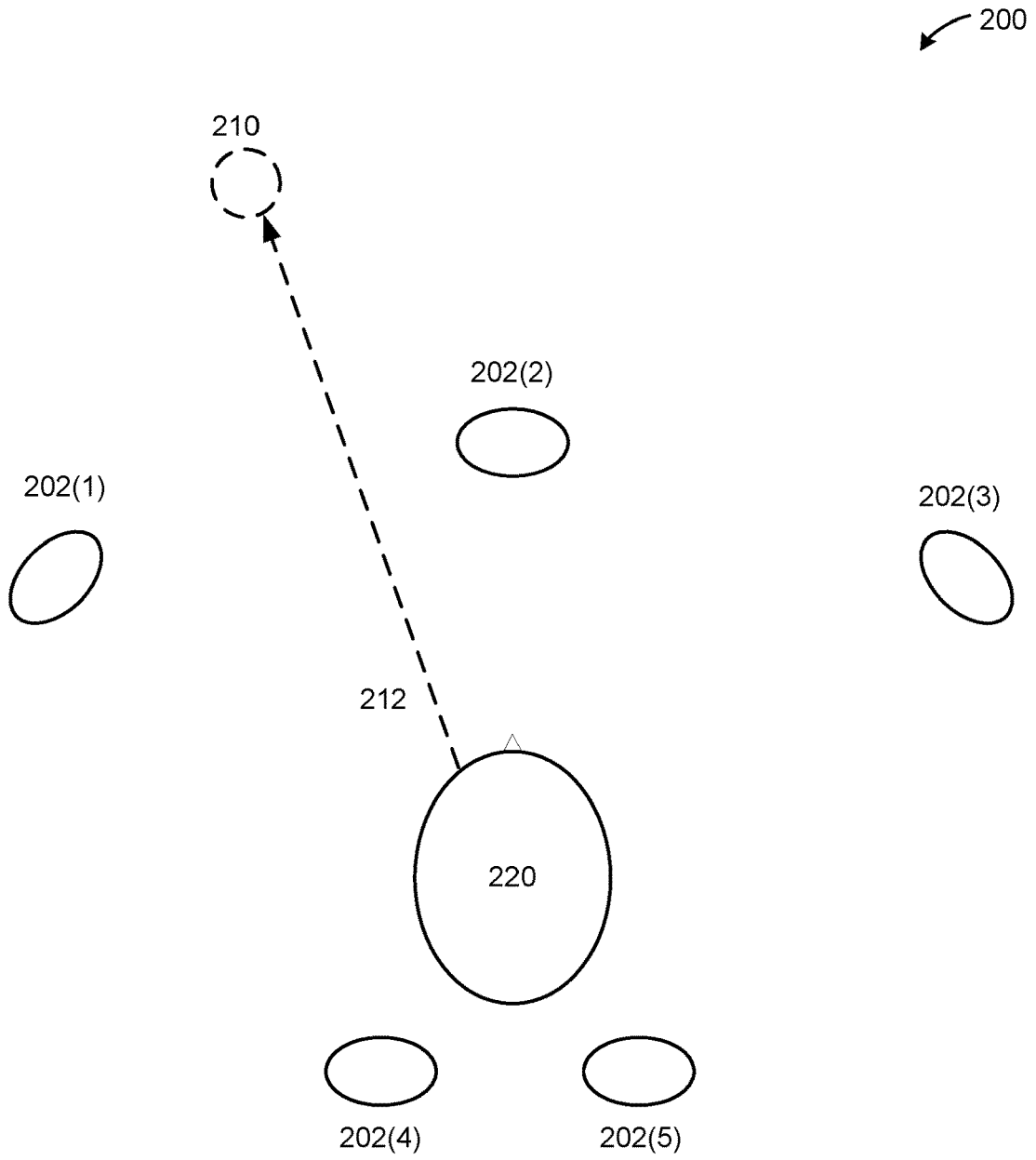
FIG. 2 illustrates an example speaker arrangement of an acoustic system, according to various embodiments.

FIG. 2 illustrates an example speaker arrangement of an acoustic system 200, according to various embodiments. As shown in FIG. 2, acoustic system 200 includes a plurality of speakers 202(1)-(5). Each speaker 202 is physically located at a different position within the listening environment of the acoustic system 200. A listener 220 is positioned in proximity to the speakers 202. The listener 220 is oriented such that the front of listener 220 is facing speaker 202(2). Speakers 202(1) and 202(3) are positioned to the front left and front right, respectively, of the listener 220. Speakers 202(4) and 202(5) are positioned behind the listener 220. In some embodiments, speakers 202(4) and 202(5) form a dipole group.

Listener 220 listens to sounds emitted by acoustic system 200 via the speakers 202. To provide an immersive listening experience, acoustic system 200 renders audio such that the listener 220 perceives the audio as being located at specific positions within the listening environment. As shown in FIG. 2, a portion of audio is associated with a target position 210. Target position 210 is at a distance 212 from listener 220 within the listening environment. The desired audio signals produced by acoustic system 200 should be perceived as originating from the target position 210 when heard by listener 220.

In some embodiments, a subset of the speakers included in the plurality of speakers 202 is selected for producing the desired audio signals. That is, a subset of speakers 202 are selected that are better able to reproduce immersive audio with the desired target behavior. In some embodiments, the subset of speakers 202 includes at least three speakers. In some embodiments, the subset of speakers includes at least a first speaker 202 that is positioned to the left of the listener and a second speaker 202 that is positioned to the right of the listener, relative to the direction in which the speaker is oriented. For example, the subset could include at least one of speakers 202(1) or 202(4) and at least one of speakers 202(3) or 202(5). In some embodiments, the subset of speakers includes at least a first speaker that is positioned in front of the listener and a second speaker that is positioned behind the listener, relative to the direction in which the speaker is oriented. For example, the subset could include at least one of speakers 202(1), 202(2), or 202(3) and at least one of speakers 202(4) or 202(5).

In some embodiments, to select the subset of speakers 202, the perceptual distance between each speaker 202 and the target position 210 is determined. The perceptual distance indicates how far, in a perceptual sense, a speaker 202 is from the target position 210. The speakers 202 that are closest, perceptually, to the target position 210 are selected as the subset of speakers.

Figure 3:
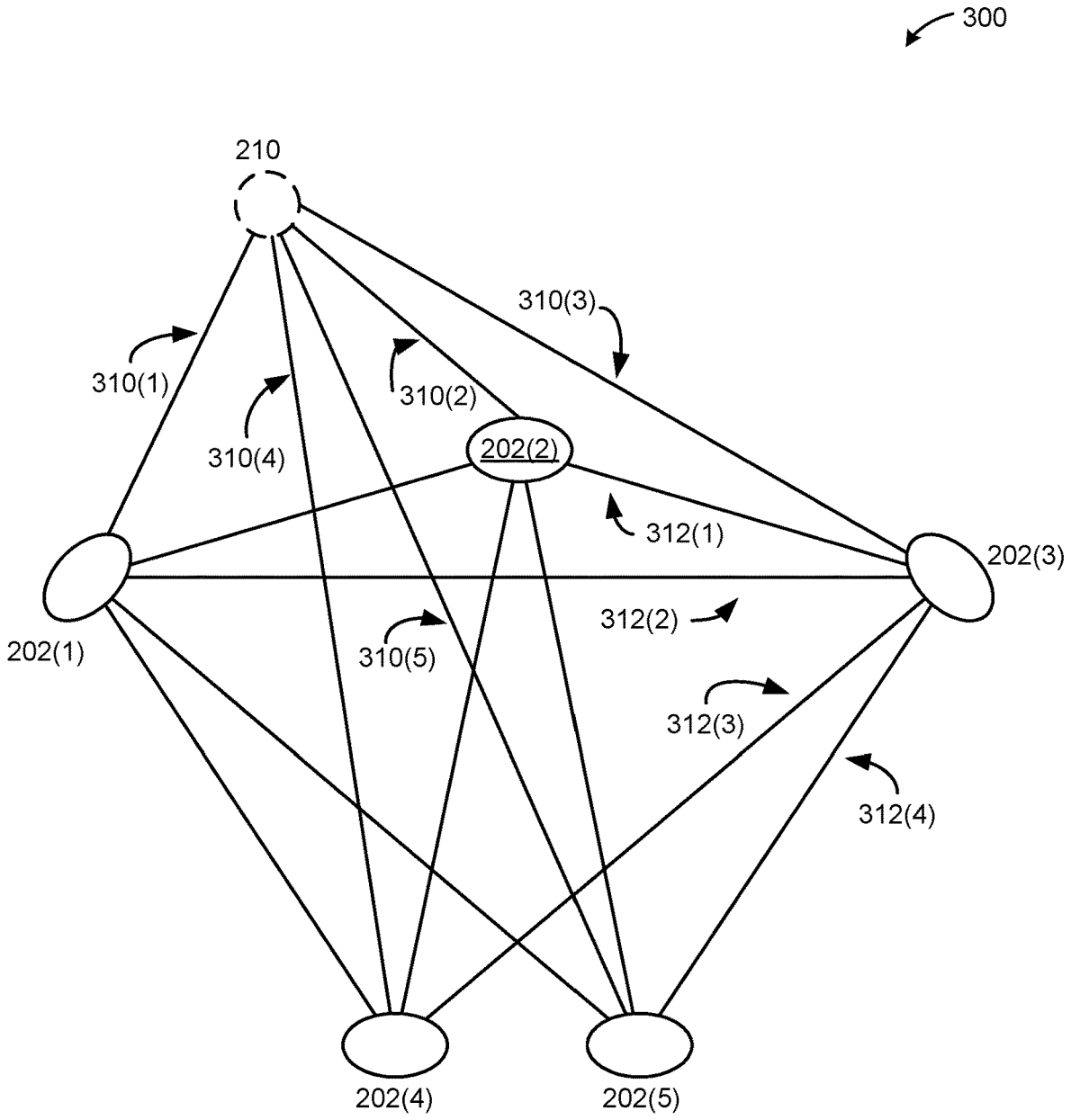
FIG. 3 illustrates an example graph representation of the acoustic system of FIG. 2, according to various embodiments.

FIG. 3 illustrates a graph representation 300 of the acoustic system 200 of FIG. 2, according to various embodiments. As shown in FIG. 3, each speaker 202(1)-(5) and the target position 210 is represented as a different node in graph representation 300. Each node representing a speaker 202 is connected to the node representing the target position 210 by an edge of the graph representation 300, such as edges 310(1)-(5). Each node representing a speaker 202 is also connected to each other node representing another speaker 202 by an edge of the graph representation 300. For example, the node representing speaker 202(3) is connected to the nodes representing speakers 202(1), 202(2), 202(4) and 202(5) by edges 312(1)-(4), respectively.

In some embodiments, a first perceptual function ($\lambda_1$) is used to compute, for each edge of the graph representation 300, a weight associated with the edge. The weight indicates the perceptual distance between the nodes connected to the edge, i.e., the perceptual distance between a pair of speakers 202 or between a speaker 202 and target position 210.

In some embodiments, the first perceptual function is implemented using a set of one or more heuristics and/or rules. The set of one or more heuristics and/or rules could consider, for example, the number of listeners within the listening environment, the position of the listener(s), the orientation of the listener(s), the number of speakers in the acoustic system, the location of the speakers, whether a pair of speakers form a dipole group, the position of the speakers relative to the position of the listener(s), the location of the target position relative to the position of the listener(s), the orientation of the target position relative to the orientation of the listener(s), the type of listening environment, and/or other characteristics of the listening environment and/or acoustic system. The specific heuristics and/or rules may vary, for example, depending on the given acoustic system, the given listening environment in which the acoustic system is located, the type of audio being played, user-specified preferences, and so forth.

In some embodiments, based on the characteristics of a given acoustic system, a feature vector set $X=\{x_1, x_2, \ldots, x_n\}$ is generated that describes the speakers in the given acoustic system, where n represents the number of speakers in the given acoustic system and each feature vector x in the feature vector set characterizes a corresponding speaker in terms of the set of one or more heuristics. In some embodiments, each feature in the feature vector corresponds to a different feature and/or factor considered by the set of heuristics. As an example, a set of heuristics could consider the angular distance from the speaker to the target position, the physical distance from the speaker to the target position, the speaker being part of a dipole group, the angular distance from the speaker to the listener, the physical distance from the speaker to the listener, and/or the orientation of the listener compared to the orientation of the source. In some embodiments, the angular distance from a speaker to the target position represents a difference between the orientation of the speaker and the orientation of the target position, relative to the listener. In some embodiments, the angular distance from a speaker to the listener represents a difference between the orientation of the speaker and the orientation of the listener, relative to the target position. In some examples, a feature vector $x_1$ could include one or more of a first feature $x_{i,1}$ corresponding to the angular distance from the i-th speaker to the target position 210, a second feature $x_{i,2}$ corresponding to the physical distance from the i-th speaker to the target position 210, a third feature $x_{i,3}$ corresponding to whether the i-th speaker is part of a dipole group, a fourth feature $x_{i,4}$ corresponding to the angular distance from the i-th speaker to the listener 220, a fifth feature $x_{i,5}$ corresponding to the physical distance from the i-th speaker to the listener 220, or a sixth feature $x_{i,6}$ corresponding to the orientation of the listener 220 relative to the orientation of the target position 210. Additionally, in some embodiments, a feature vector is generated for the target position. In some embodiments, the features and/or factors considered by the set of heuristics for the target position are similar to or the same as the features and/or factors discussed above with respect to the speakers in the acoustic system.

Referring to FIG. 3, a feature vector set is generated that corresponds to the speakers 202(1)-(5). Each feature vector describes characteristics of a speaker 202 in terms of the set of one or more heuristics. In some embodiments, generating the graph representation 300 includes generating the feature vector set corresponding to the speakers 202 and associating each feature vector with the corresponding node in the graph. The weight corresponding to an edge is computed based on the feature vectors associated with the nodes connected by the edge. An example function $\lambda_1$ for computing the weight corresponding to an edge of the graph representation 300 is given by equation (5):

$$W_{ij} = \exp\left(-\frac{\|x_i - x_j\|}{2\sigma^2}\right) \quad (5)$$

In equation (5), $W_{ij}$ represents the weight of the edge between the i-th node and the j-th node in the graph representation 300. $x_i$ represents the feature vector associated with the i-th node and $x_j$ represents the feature vector associated with the j-th node. $\sigma$ represents the standard deviation of the feature values.

Figure 4:
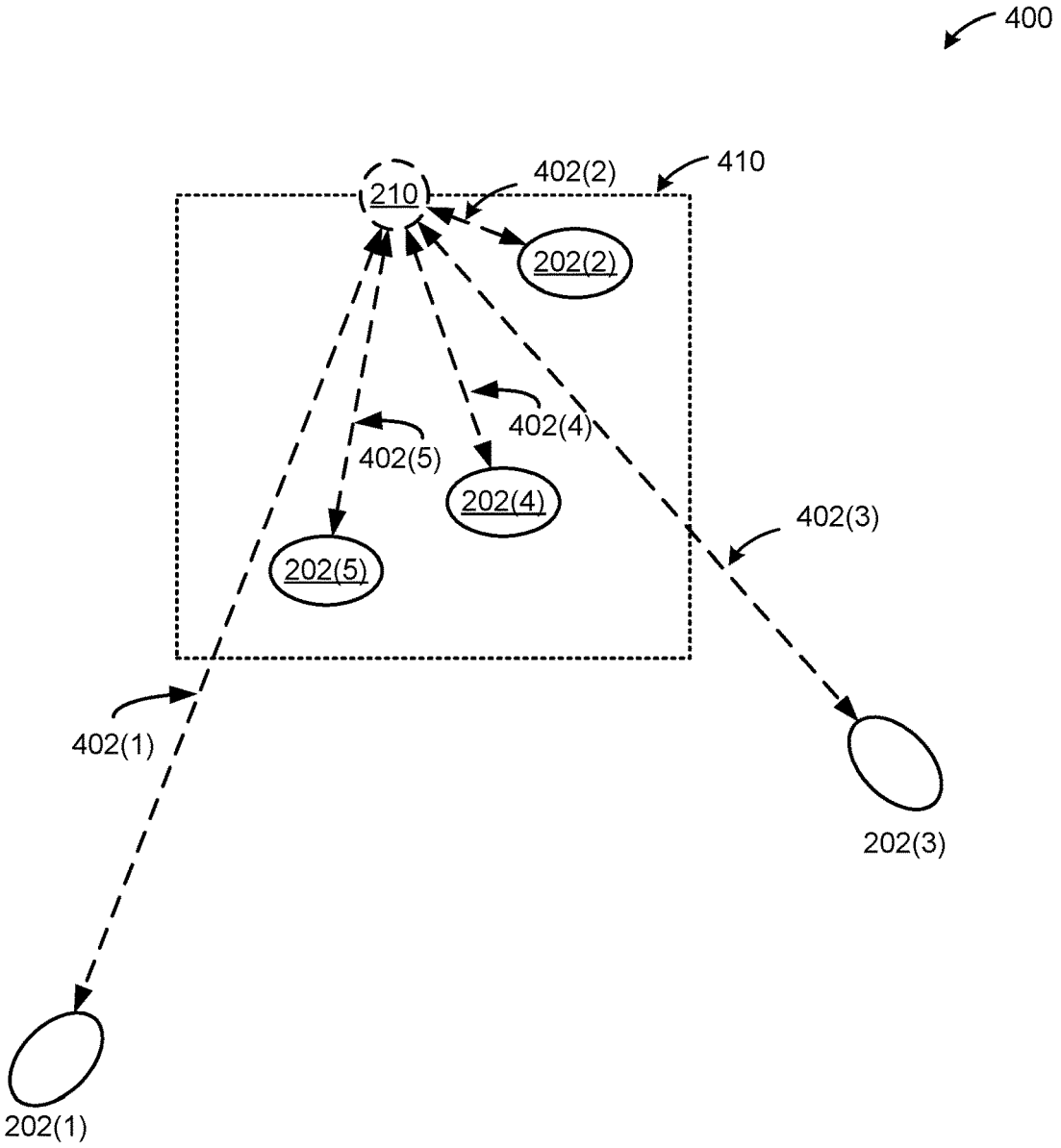
FIG. 4 illustrates perceptual distances between the speakers of the acoustic system of FIG. 2, according to various embodiments.

FIG. 4 illustrates a representation 400 the perceptual distances 402 between the speakers 202 and the target position 210, according to various embodiments. As shown in FIG. 4, speakers 202(1)-(5) are a perceptual distance 402(1)-(5), respectively, from target position 210. Each perceptual distance 402 is computed based on evaluating features of the connected nodes in accordance with a set of rules and/or heuristics. For example, perceptual distance 402(1) corresponds to the weight computed for edge 310(1), based on the features of speaker 202(1) and the target position 210.

The perceptual distance from a speaker 202 to the target position 210 can differ from the physical distance, within the listening environment, from the speaker 202 to the target position 210. As shown in FIG. 4, speaker 202(2), speaker 202(4), and speaker 202(5) are the closest, perceptually, to the target position 210, while speaker 202(1) is the furthest away from the target position 210. However, with reference to FIG. 2, speakers 202(1) and 202(2) are the closest, physically, to target position 210. Similarly, speakers 202(4) and 202(5) are positioned, physically, further away from the target position 210, but the perceptual distance 402(4) and 402(5) indicate that the speakers 202(4) and 202(5) are perceptually close to the target position 210.

As shown in FIG. 4, a subset of speakers 410 are selected based on the perceptual distances to the target position 210, e.g., perceptual distances 402(1)-(5). The selection may be performed using any technically feasible algorithm for selecting or identifying nearby nodes from a graph. In some embodiments, a subset of speakers 202 are selected based on the graph representation 300 using a clustering algorithm, such as Kruskal's algorithm. The clustering algorithm divides the nodes of graph representation 300 into one or more subgraphs where the nodes within a subgraph are perceptually close to the other nodes in the subgraph, i.e., have the shortest perceptual distances to the other nodes in the subgraph. The selected subset of speakers 202 include the speakers (e.g., speakers 202(2), 202(4), and 202(5)) that belong in the same subgraph as the target position 210.

After the subset of speakers 202 are selected, a set of filters are generated for rendering audio using the selected subset of speakers 202. Referring to equation (4), a set of filters h is generated based on a matrix C that represents the acoustic properties of the subset of speakers 202. The set of filters h are calculated such that the set of filters h are the inverse of the matrix C. When h is the inverse of C, equation (4) evaluates to the equation shown in equation (2), i.e., the acoustic system is configured to a target acoustic system that produces the desired audio signals. As discussed above, if the acoustic system represented by C is ill-conditioned, then computing h based on C results in an acoustic system with reduced dynamic range. In some embodiments, to improve the sound generated by the acoustic system, the set of filters h is computed based on a matrix C that represents the selected subset of speakers, rather than the entire acoustic system.

Figure 5:
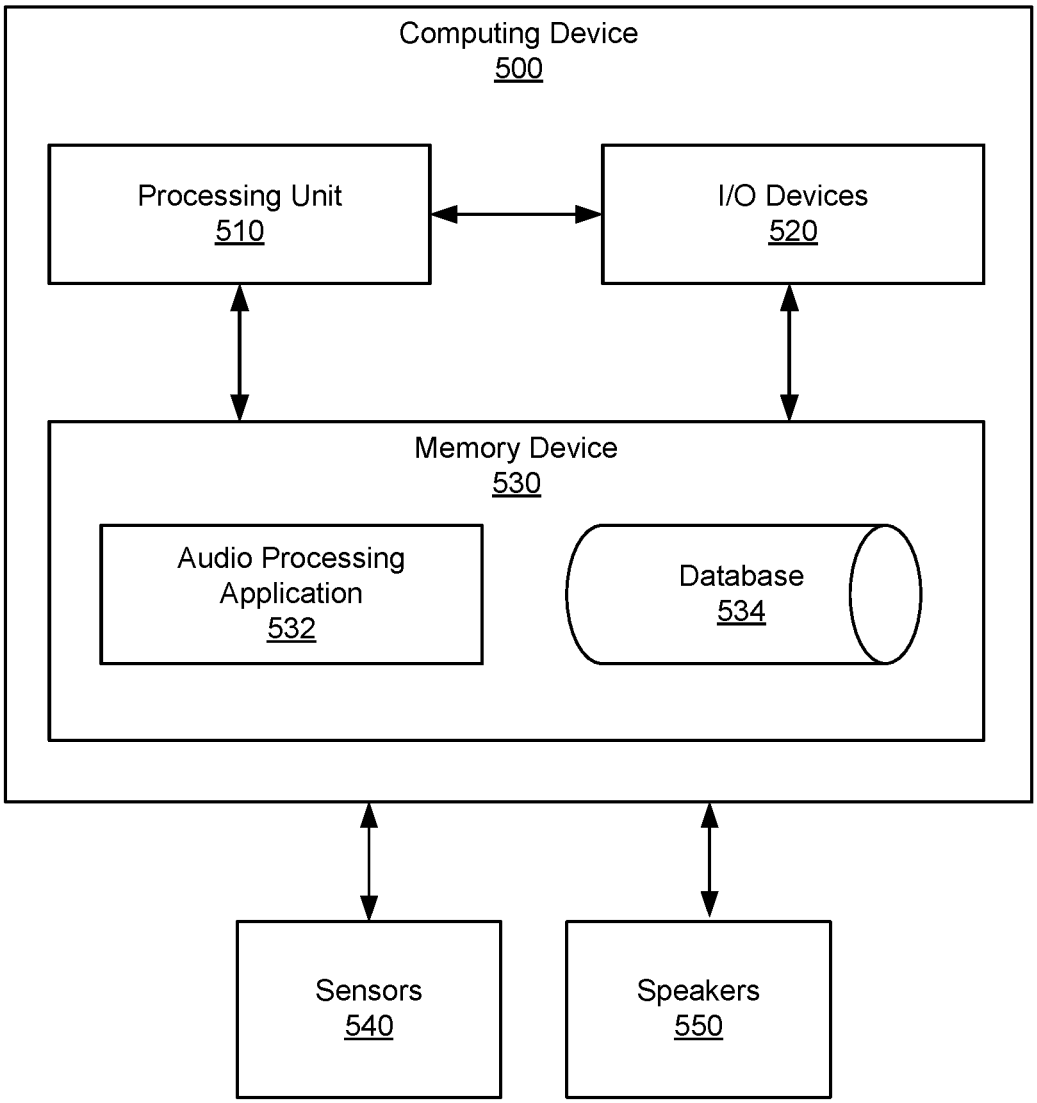
FIG. 5 illustrates a block diagram of an example computing device for use with or coupled to an acoustic system, according to various embodiments.

FIG. 5 illustrates a block diagram of an example computing device 500 for use with or coupled to an acoustic system, according to various embodiments. As shown, computing device 500 includes a processing unit 510, input/output (I/O) devices 520, and a memory device 530. Memory device 530 includes an audio processing application 532 that is configured to interact with a database 534. Computing device 500 is coupled to one or more sensors 540 and a plurality of speakers 550.

Processing unit 510 may include one or more central processing units (CPUs), one or more digital signal processing unit (DSPs), and/or the like. Processing unit 510 is configured to execute an audio processing application 532 to perform one or more of the audio processing functionalities described herein.

I/O devices 520 may include input devices, output devices, and devices capable of both receiving input and providing output. For example, and without limitation, I/O devices 520 may include wired and/or wireless communication devices that send data to and/or receive data from the sensor(s) 540, the speakers 550, and/or various types of audio-video devices (e.g., mobile devices, DSPs, amplifiers, audio-video receivers, and/or the like) to which the acoustic system may be coupled. Further, in some embodiments, the I/O devices 520 include one or more wired or wireless communication devices that receive sound components (e.g., via a network, such as a local area network and/or the Internet) that are to be reproduced by the speakers 550.

Memory device 530 may include a memory module or a collection of memory modules. Audio processing application 532 within memory device 530 may be executed by processing unit 510 to implement the audio processing functionality of the computing device 500, such as determining target positions associated with input audio signals, determining feature data associated with an acoustic system, selecting speakers of the acoustic system, generating audio filters, and/or the like. The database 534 may store digital signal processing algorithms, sets of heuristics and rules, sound components, speaker feature data, object recognition data, position data, orientation data, and/or the like.

Computing device 500 as a whole can be a microprocessor, a system-on-a-chip (SoC), a mobile computing device such as a tablet computer or cell phone, a media player, and/or the like. In some embodiments, the computing device 500 can be coupled to, but separate from the acoustic system. In such embodiments, the acoustic system 100 can include a separate processor that receives data (e.g., speaker signals) from and transmits data (e.g., sensor and system data) to the computing device 500, which may be included in a consumer electronic device, such as a smartphone, portable media player, personal computer, vehicle head unit, navigation system, and/or the like. For example, and without limitation, the computing device 500 may communicate with an external device that provides additional processing power. However, the embodiments disclosed herein contemplate any technically feasible system configured to implement the functionality of any of the acoustic systems described herein.

In some embodiments, computing device 500 is configured to analyze data acquired by the sensor(s) 540 to determine positions and/or orientations of one or more listeners within a listening environment of the acoustic system. In some embodiments, computing device 500 receives position data indicating the positions of the one or more listeners and/or orientation data indicating the orientations of the one or more listeners from another computing device. In some embodiments, computing device 500 stores position data indicating the positions of the one or more listeners in database 534 and/or stores orientation data indicating the orientations of the one or more listeners in database 534.

In some embodiments, computing device 500 is configured to analyze data acquired by the sensor(s) 540 to determine positions and/or orientations of one or more speakers of the acoustic system. In some embodiments, computing device 500 receives position data indicating the positions of the one or more speakers and/or orientation data indicating the orientations of the one or more speakers from another computing device and/or from the acoustic system. In some embodiments, computing device 500 stores position data indicating the positions of the one or more speakers and/or stores orientation data indicating the orientations of the one or more speakers in database 534.

In some embodiments, computing device 500 is configured to analyze data acquired by the sensor(s) 540 to determine one or more properties of the listening environment, such as the type of listening environment, acoustic properties of the listening environment, the positions of one or more objects within the listening environment, the orientations of one or more objects within the listening environment, the reflectivity of one or more objects within the listening environment, and/or the like. In some embodiments, computing device 500 receives environment data indicating the one or more properties of the listening environment from another computing device and/or from user input, for example via the I/O devices 520. In some embodiments, computing device 500 stores environment data indicating the one or more properties of the listening environment in database 534.

As explained in further detail below, computing device 500 is configured to receive an audio input signal. A portion of the audio input signal is associated with a specific position within the listening environment. Computing device 500 selects a subset of speakers included in the acoustic system for playing the portion of the audio input signal. Computing device 500 generates, for each speaker in the subset, a speaker signal based on the portion of the audio input signal. Generating the speaker signal could be based on, for example, the position and/or orientation of the speaker relative to the position and/or orientation of the user, the position and/or orientation of the speaker relative to the specific position, the position and/or orientation of the speaker relative to the position and/or orientation of other speakers in the subset, and/or one or more properties of the listening environment. When the speaker signals generated by the computing device 500 are emitted by the subset of speakers, the sound heard by a listener is perceived by the listener as being located at the specific position.

In some embodiments, computing device 500 transmits the generated speaker signals to the acoustic system. In some embodiments, computing device 500 transmits the generated speaker signals to one or more other computing devices for further processing. For example, computing device 500 could transmit the speaker signals to a mixer. The mixer determines a mix ratio between using the speaker signals and speaker selection determined by computing device 500 and using speaker signals and speaker selections determined by other computing devices and/or using other methods.

Figure 6A:
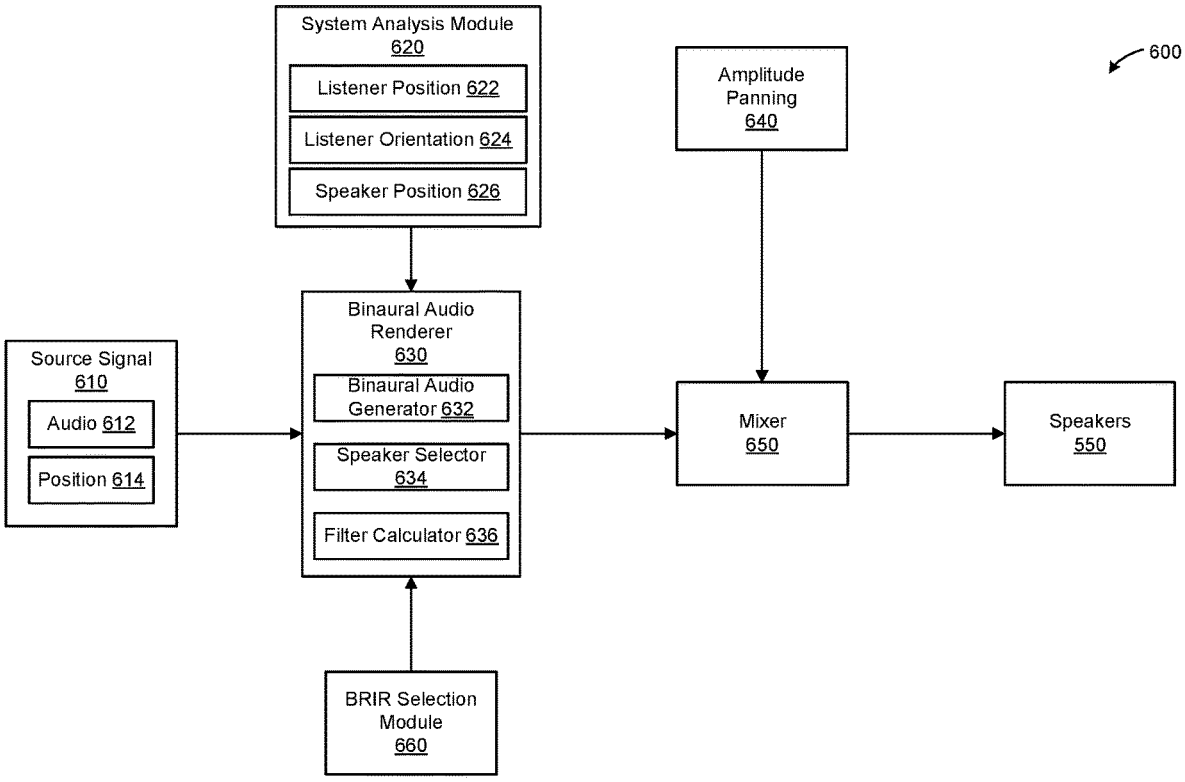
FIG. 6A illustrates an example acoustic system for producing immersive sounds, according to various embodiments.

FIG. 6A illustrates an example acoustic system 600 for producing immersive sounds, according to various embodiments. As shown in FIG. 6A, acoustic system 600 includes a system analysis module 620, binaural audio renderer 630, a mixer 650, BRIR selection module 660, and a plurality of speakers 550. Acoustic system 600 receives a source signal 610. Source signal 610 includes audio 612, which is associated with a position 614.

Binaural audio renderer 630 receives the source signal 610 and generates a set of speaker signals that can be provided to at least a subset of the speakers 550. Binaural audio renderer 630 can be included as part of an audio processing application 532. In some embodiments, system analysis module 620, binaural audio renderer 630, mixer 650, and BRIR selection module 660 are each included in audio processing application 532. In some embodiments, one or more of system analysis module 620, mixer 650, or BRIR selection module 660 comprise applications separate from audio processing application 532 and/or are implemented separately on computing device 500 and/or on computing devices separate from computing device 500. As shown, binaural audio renderer 630 includes binaural audio generator 632, speaker selector 634, and filter calculator 636.

In some embodiments, if source signal 610 comprises non-binaural audio, binaural audio renderer 630 converts the non-binaural audio to binaural audio. In operation, binaural audio generator 632 receives the audio 612 and position 614 included in source signal 610, and generates binaural audio based on the audio 612 and position. Binaural audio generator 632 may generate the binaural audio using any technically feasible method(s) for generating binaural audio based on non-binaural audio.

Speaker selector 634 receives the position 614 included in source signal 610 and selects a subset of speakers from speakers 550. Speaker selector 634 selects the subset of speakers from speakers 550 based on a set of one or more heuristics and/or rules, such as illustrated in the examples of FIGS. 3 and 4. The set of one or more heuristics and/or rules could consider, for example, the number of listeners within the listening environment, the position of the listener(s), the orientation of the listener(s), the number of speakers in the acoustic system, the location of the speakers, whether a pair of speakers form a dipole group, the position of the speakers relative to the position of the listener(s), the location of the target position relative to the position of the listener(s), the orientation of the target position relative to the orientation of the listener(s), the type of listening environment, and/or other characteristics of the listening environment and/or acoustic system.

In some embodiments, speaker selector 634 evaluates the set of heuristics and/or rules based on position and/or orientation data associated with one or more listeners in the listening environment and the speakers 550. Additionally, speaker selector 634 could evaluate the set of heuristics and/or rules based on properties of the listening environment and/or the acoustic system.

In some embodiments, speaker selector 634 retrieves position data, orientation data, and/or environment data from a database 534. In some embodiments, speaker selector 634 receives the position data, orientation data, and/or environment data from system analysis module 620. System analysis module 620 is configured to analyze sensor data, e.g., from sensor(s) 540, and generate the position data, orientation data, and/or environment data. Additionally, in some embodiments, system analysis module 620 is further configured to analyze information associated with the acoustic system 600, such as system properties, speaker configuration information, user configuration information, user input data, and/or the like, when generating the position data, orientation data, and/or environment data.

As shown, system analysis module 620 generates data indicating listener position(s) 622, listener orientation(s) 624, and speaker position(s) 626. Listener position(s) 622 indicates, for each listener in the listening environment, the position of the listener within the listening environment. Listener orientation(s) 624 indicates, for each listener in the listening environment, the orientation of the listener within the listening environment. Speaker position(s) 626 indicates, for each speaker 550 in the acoustic system 600, the position of the speaker within the listening environment. In various embodiments, the data generated by system analysis module 620 could include fewer types of data or could include additional types of data not shown in FIGS. 6A-6B, such as data indicating other properties of the acoustic system and/or of the listening environment.

In some embodiments, speaker selector 634 calculates a perceptual distance between each speaker 550 and the position 614. The perceptual distance between a speaker 550 and the position 614 indicates how close the speaker 550 is to the position 614 based on evaluating the set of heuristics and/or rules. In some embodiments, speaker selector 634 generates a feature vector set corresponding to the plurality of speakers 550. The feature vector set includes a different feature vector for each speaker included in the plurality of speakers 550. Each feature vector includes one or more feature values, where each feature value corresponds to a different feature and/or factor considered by a heuristic or rule in the set of heuristics and/or rules. Speaker selector 634 calculates the perceptual distance between each speaker 550 and the position 614 based on the feature vector corresponding to the speaker 550. An example equation for computing the perceptual distance between a speaker 550 and the position 614 is described above with reference to equation (5).

Speaker selector 634 selects a subset of speakers 550 based on the perceptual distances from the speakers 550 to the position 614. In some embodiments, speaker selector 634 selects the subset of speakers 550 that are closest, perceptually, to the position 614.

In some embodiments, selecting the subset of speakers 550 is further based on a threshold number of speakers in the subset. Speaker selector 634 selects at least the threshold number of speakers that are closest, perceptually, to the position 614. For example, if the threshold number of speakers is three, speaker selector 634 selects the three speakers 550 with the shortest perceptual distance to the position 614.

In some embodiments, selecting the subset of speakers 550 is further based on a threshold perceptual distance. Speaker selector 634 selects the speakers 550 whose perceptual distance to the position 614 is less than the threshold perceptual distance.

In some embodiments, selecting the subset of speakers 550 is further based on the positions of the speakers 550 relative to the position of a listener. For example, the subset of speakers 550 could be required to include at least one speaker positioned to the left of the listener and at least one speaker positioned to the right of the listener. Speaker selector 634 selects a first speaker 550 with the shortest perceptual distance to the position 614 that is positioned to the left of the listener, and a second speaker 550 with the shortest perceptual distance to the position 614 that is positioned to the right of the listener. As another example, the subset of speakers 550 could be required to include at least one speaker positioned in front of the listener and at least one speaker positioned behind of the listener. Speaker selector 634 selects a first speaker 550 with the shortest perceptual distance to the position 614 that is positioned in front of the listener, and a second speaker 550 with the shortest perceptual distance to the position 614 that is positioned behind the listener.

In some embodiments, speaker selector 634 generates a graph representation comprising a plurality of nodes and a plurality of edges between the plurality of nodes. Each node corresponds to a different speaker included in the plurality of speakers 550. Additionally, the graph representation includes a node corresponding to the position 614. Speaker selector 634 computes a weight associated with each edge based on the nodes connected by the edge, where the weight indicates the perceptual distance between the element of acoustic system 600 represented by the connected nodes (e.g., a speaker 550 or the position 614 of the source signal 610).

In some embodiments, speaker selector 634 generates a feature vector set and generates a node of the graph representation for each feature vector included in the feature vector set. Speaker selector 634 computes the weight for each edge of the graph representation using the feature vectors corresponding to the connected nodes.

In some embodiments, speaker selector 634 selects the subset of speakers 550 based on the weights associated with the edges of the graph representation. For example, speaker selector 634 could apply a clustering algorithm to identify clusters of nodes in the graph representation. Speaker selector 634 selects a subset of speakers 550 that are included in a cluster that also includes the position 614.

Filter calculator 636 generates a set of filters based on the subset of speakers 550 selected by speaker selector 634. The set of filters includes, for each speaker 550, one or more filters to apply to the source signal 610 to generate a speaker signal for the speaker 550. In some embodiments, filter calculator 636 generates the set of filters based on properties of the subset of speakers 550 and one or more target characteristics associated with a target sound. The set of filters are applied to the source signal 610 to generate speaker signals that, when emitted by the subset of speakers 550, produce the target sound. In some embodiments, filter calculator 636 determines an equation representing the properties of the subset of speakers 550 and the one or more target characteristics. Filter calculator 636 evaluates the equation to generate the set of filters.

In some embodiments, a BRIR (binaural room impulse response) selection module 660 selects a binaural room impulse response based on reverberant characteristics of the listening environment. The binaural room impulse response can be used to modify the speaker signals in order to account for the reverberant characteristics of the listening environment. In some embodiments, the binaural room impulse response is applied to the source signal 610 in conjunction with the set of filters. In some embodiments, the binaural room impulse response is used when selecting the set of speakers and/or generating the set of filters. For example, the BRIR could be used as a target characteristic for generating the set of filters, as discussed above with respect to equation (3C).

As shown in FIG. 6A, the speaker signals generated by binaural audio renderer 630 are transmitted to a mixer 650. Mixer 650 determines a mix ratio between using binaural rendering produced by the binaural audio renderer 630 and using other audio rendering techniques. As shown, mixer 650 determines a mix ratio between binaural audio renderer 630 and amplitude panning 640. Amplitude panning 640 applies source signal 610 equally to the plurality of speakers 550. With amplitude panning 640, the position that the listener perceives the sound as being located is varied by modifying the amplitudes of source signal 610 when output by each respective speaker 550. Mixer 650 transmits speaker signals to the speakers 550 in accordance with the determined mix ratio.

In some embodiments, mixer 650 uses a second perceptual function ($\lambda_2$) to determine the mix ratio between binaural audio renderer 630 and amplitude panning 640. The second perceptual function is a function that is implemented using a set of one or more heuristics and/or rules. The set of one or more heuristics and/or rules could consider, for example, the number of listeners within the listening environment, the position of the listener(s), the orientation of the listener(s), the number of speakers in the plurality of speakers 550, desired sound zone(s) performance, the type of listening environment or other characteristics of the listening environment, and/or user preferences. The set of heuristics and/or rules implemented by the $\lambda_2$ function can vary from the set of heuristics and/or rules implemented by the $\lambda_1$ function. Additionally, the specific heuristics and/or rules may vary, for example, depending on the rendering methods being mixed, the given acoustic system, the given listening environment in which the acoustic system is located, the type of audio being played, user-specified preferences, and so forth.

In some embodiments, mixer 650 uses the second perceptual function to generate a score associated with binaural rendering. As an example, each heuristic or rule in the set of heuristics and/or rules could be associated with a positive or negative value (e.g., +1, −1, +5, −5, etc.). Mixer 650 evaluates each heuristic or rule and includes the value associated with the heuristic or rule if the heuristic or rule is satisfied by acoustic system 600. Mixer 650 generates an overall score based on the values associated with the set of heuristics and/or rules. Mixer 650 determines, based on the overall score, an amount of binaural rendering to use relative to an amount of amplitude panning.

Figure 8:
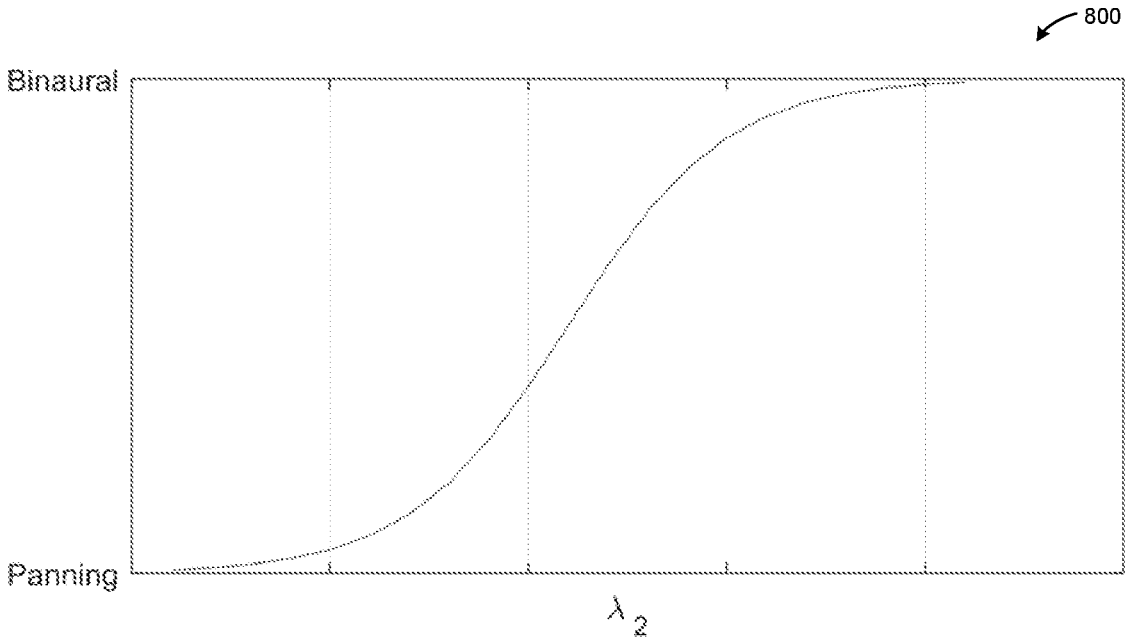
FIG. 8 illustrates an example mapping between overall scores and mix ratios, according to various embodiments.

In some embodiments, a set of overall scores are mapped to different ratios of binaural rendering and amplitude panning. Mixer 650 determines, based on the mapping, the ratio that corresponds to the overall score. FIG. 8 illustrates an example mapping between overall scores and mix ratios, according to various embodiments. As shown in FIG. 8, graph 800 maps different overall scores generated by the $\lambda_2$ function and different amounts of binaural rendering and amplitude panning. Although the graph 800 illustrated in FIG. 8 depicts a non-linear relationship between overall scores and mix ratios, other types of relationships may be used.

As an example, table (1) illustrates an example set of rules associated with perceptual function $\lambda_2$:

TABLE 1

| Value | Rule |
|---|---|
| 5 | Prefer sound zone performance |
| −5 | Only one occupant |
| −10 | No headrest speaker |
| 10 | Multi-dipole CTC (crosstalk cancellation) in car |
| −10, . . . , 10 | User Preference(s) |

As shown in table (1), each rule is associated with an integer value. The value associated with each rule is associated with an importance of the rule. For example, the rules include one or more user preferences. The user preferences could be associated with larger values so that the user preferences are weighted more heavily when evaluating the set of rules.

Mixer 650 evaluates each rule to determine whether the value associated with the rule should be included in the $\lambda_2$ function. An example $\lambda_2$ function for computing an overall score based on the values is given by equation (6):

$$\lambda_2(val) = \frac{1}{1 + e^{-k(val-\theta)}} \tag{6}$$

In equation (6), val represents the sum of the values associated with the set of rules. k represents a parameter that is used to change how fast a system transitions between binaural and amplitude panning modes. The value of k can be adjusted depending on the given acoustic system. θ represents the score at which the rendering system uses equal amounts of binaural rendering and amplitude panning. Referring to FIG. 8, $\lambda_2(val)=1$ would indicate using a mix ratio with full binaural rendering only and $\lambda_2(val)=0$ would indicate using a mix ratio with amplitude panning only.

Mixer 650 transmits speaker signals to the speakers 550 according to the mix ratio. The speakers 550 emit the speaker signals and generate a sound corresponding to the audio 612. In some embodiments, rather than transmitting the set of speaker signals to a mixer 650, binaural audio renderer 630 transmits the speaker signals to the subset of speakers 550.

Figure 6B:
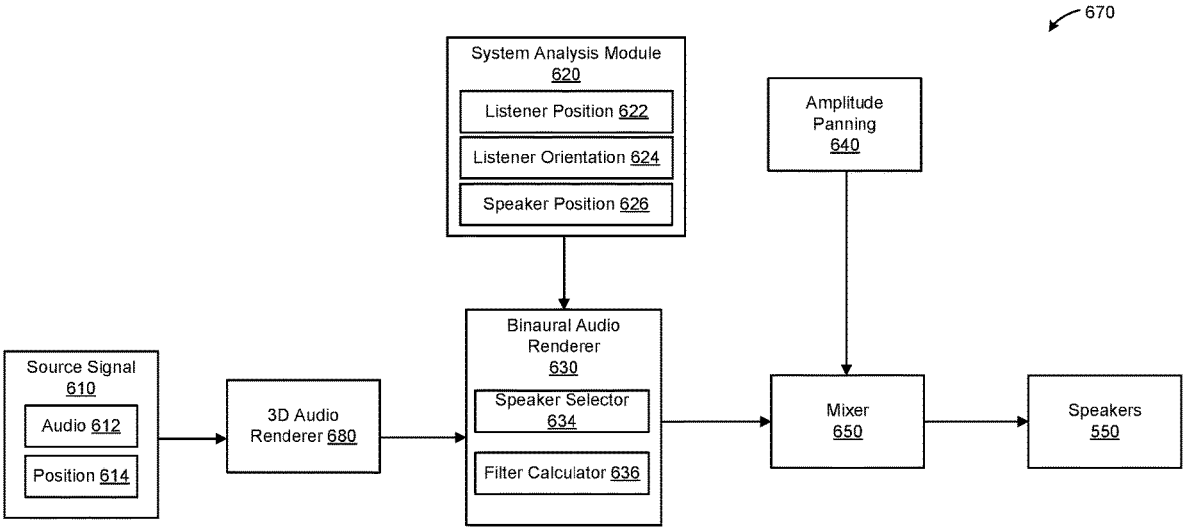
FIG. 6B illustrates an example acoustic system for producing immersive sounds, according to various other embodiments.

FIG. 6B illustrates an example acoustic system 670 for producing immersive sounds, according to various other embodiments. As shown in FIG. 6B, acoustic system 670 includes a system analysis module 620, binaural audio renderer 630, a mixer 650, a 3D audio renderer 680, and a plurality of speakers 550. Acoustic system 600 receives a source signal 610. Source signal 610 includes audio 612, which is associated with a position 614.

As shown in FIG. 6B, 3D (three-dimensional) audio renderer 680 receives the source signal 610 and provides 3D audio, such as binaural audio, to binaural audio renderer 630. In some embodiments, 3D audio renderer 680 receives the source signal 610 and converts the source signal 610 to 3D audio. In some embodiments, 3D audio renderer 680 receives source signal 610 and determines the position 614 associated with the audio 612. Determining the position 614 may include, for example, analyzing one or more audio channels included in source signal 610 to determine the position 614. For example, 3D audio renderer 680 could analyze the one or more audio channels to determine the channels in which audio 612 is audible, and determine, based on the channels in which audio 612 is audible, the position 614 corresponding to the audio 612. 3D audio renderer 680 generates, based on the position 614, 3D audio signals corresponding to the audio 612.

Binaural audio renderer 630 receives the 3D audio from 3D audio renderer 680 and generates a set of speaker signals that can be provided to at least a subset of the speakers 550. As discussed above, binaural audio renderer 630 can be included as part of audio processing application 532. In some embodiments, system analysis module 620, binaural audio renderer 630, mixer 650, and 3D audio renderer 680 are each included in audio processing application 532. In some embodiments, one or more of system analysis module 620, mixer 650, or 3D audio renderer 680 comprise applications separate from audio processing application 532 and/or are implemented separately on computing device 500 and/or on computing devices separate from computing device 500.

As shown, binaural audio renderer 630 includes speaker selector 634 and filter calculator 636. Binaural audio renderer 630 selects a subset of the speakers 550 and generates, for each speaker 550 included in the subset, a speaker signal for the speaker 550. Selecting the subset of speakers 550 and generating the speaker signals is performed in a manner similar to that discussed above with reference to FIG. 6A.

The speaker signals generated by binaural audio renderer are transmitted to a mixer 650. Mixer 650 determines a mix ratio between using binaural rendering produced by the binaural audio renderer 630 and using other audio rendering techniques. As shown, mixer 650 determines a mix ratio between binaural audio renderer 630 and amplitude panning 640. Mixer 650 transmits speaker signals to the speakers 550 in accordance with the determined mix ratio, e.g., the speaker signals generated by binaural audio renderer 630, amplitude panning 640, or a combination thereof. Determining a mix ration is performed in a manner similar to that discussed above with reference to FIG. 6A.

In some embodiments, the acoustic system 600 is configured to produce sounds with BRIR as a target characteristic, and the acoustic system 670 is configured to produce sounds with crosstalk cancellation as a target characteristic. A particular configuration of an acoustic system could be selected for rendering audio based on a desired target characteristic.

Figure 7:
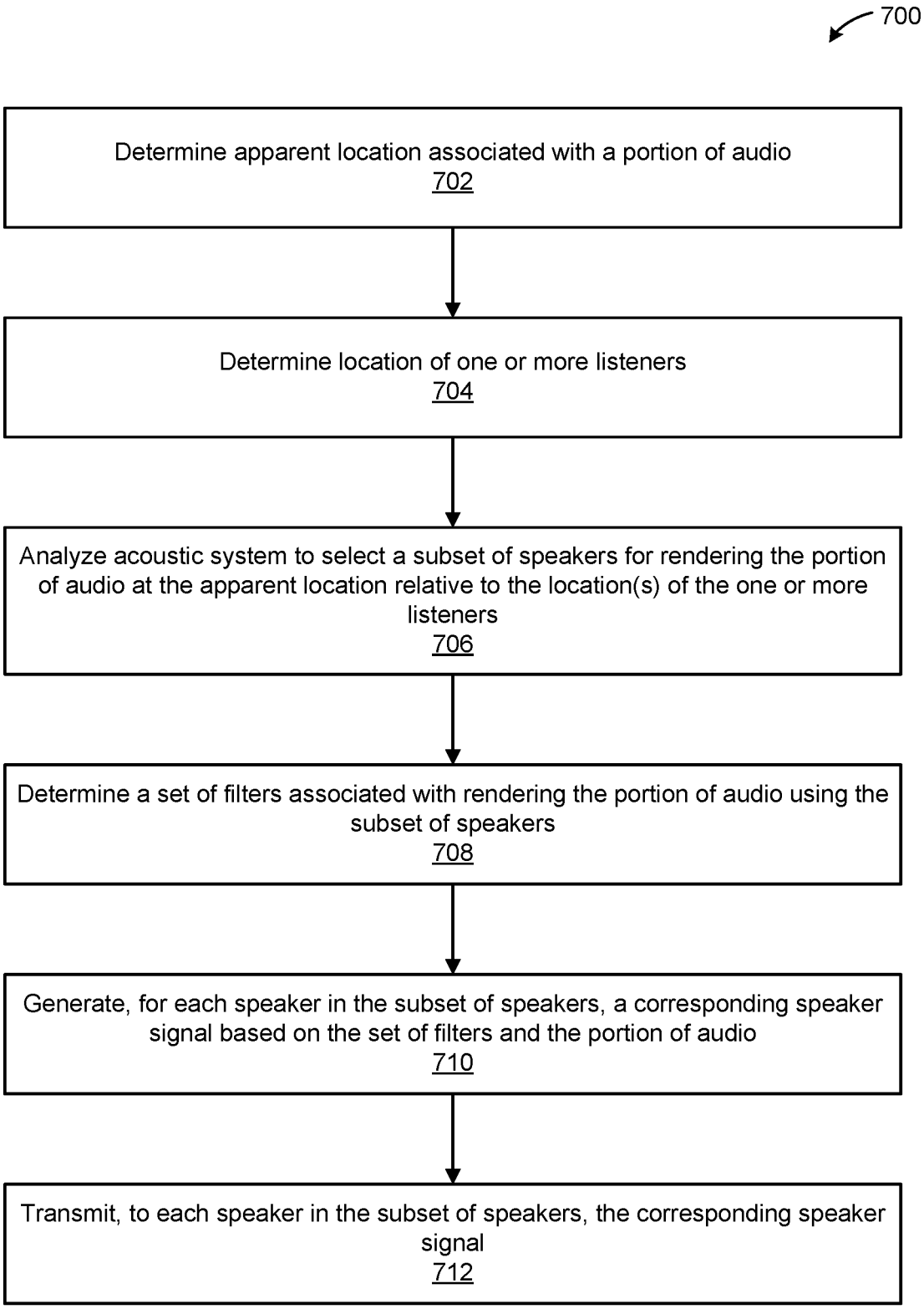
FIG. 7 illustrates a flow diagram of method steps for generating immersive audio for an acoustic system, according to various embodiments.

FIG. 7 illustrates a flow diagram of method steps for generating immersive audio for an acoustic system, according to various embodiments. Although the method steps are described in conjunction with the systems of FIGS. 5-6B, persons skilled in the art will understand that any system configured to perform the method steps, in any order, is within the scope of the present disclosure.

As shown, a method 700 begins at step 702, where an audio processing application 532 determines an apparent location associated with a portion of audio. In some embodiments, the portion of audio is associated with and/or includes metadata indicating the apparent location, and audio processing application 532 determines the apparent location based on the metadata. In some embodiments, the portion of audio comprises a plurality of audio channels. Audio processing application 532 determines one or more audio channels in which the portion of audio is audible, and determines the apparent location based on the channels in which the portion of audio is audible.

In step 704, the audio processing application 532 determines the locations of one or more listeners in the listening environment. In some embodiments, audio processing application 532 determines the locations of the one or more listeners from stored data, such as position data and/or orientation data stored in database 534. In some embodiments, audio processing application 532 determines the locations of the one or more listeners by acquiring sensor data from sensor(s) 540 and analyzing the sensor data. Determining the position and/or orientation of a listener based on sensor data may be performed using any technically feasible scene analysis or sensing techniques. In some embodiments, audio processing application 532 receives the locations of the one or more listeners, e.g., position and/or orientation data, from one or more other applications and/or computing devices that are configured to determine listener locations.

In step 706, the audio processing application 532 analyzes the acoustic system to select a subset of speakers for rendering the portion of the audio signal at the apparent location relative to the locations of the one or more listeners. Selecting the subset of speakers is performed in a manner similar to that discussed above with respect to speaker selector 634. In some embodiments, the audio processing application 532 calculates a perceptual distance between each speaker 550 and the apparent location of the portion of audio. The audio processing application 532 selects a subset of speakers that are the closest, perceptually, to the apparent location.

In some embodiments, audio processing application 532 generates a feature vector set corresponding to a plurality of speakers 550. The feature vector set includes a different feature vector for each speaker included in the plurality of speakers 550. Each feature vector includes one or more feature values, where each feature value corresponds to a different feature considered by a heuristic or rule in the set of heuristics and/or rules. Audio processing application 532 calculates the perceptual distance between each speaker 550 and the apparent location of the portion of audio based on the feature vector corresponding to the speaker 550.

In some embodiments, audio processing application 532 generates a graph representation corresponding to the plurality of speakers 550 and the apparent location of the portion of audio. Audio processing application 532 generates, for each speaker 550 and for the apparent location, a corresponding node in the graph representation. Audio processing application 532 generates, for each speaker 550, an edge between the node representing the speaker 550 and the node representing the apparent location, and associates the edge with the perceptual distance between the speaker 550 and the apparent location. In some embodiments, audio processing application 532 further generates, for each speaker 550, an edge between the node representing the speaker 550 and the nodes representing each other speaker 550, and associates each edge with the perceptual distance between the speaker 550 and the other speaker 550. Audio processing application 532 performs one or more graph clustering operations on the graph representation to identify the subset of speakers that are closest, perceptually, to the apparent location of the portion of audio.

In step 708, the audio processing application 532 determines a set of filters associated with rendering the portion of the audio signal using the subset of speakers. Determining a set of filters is performed in a manner similar to that discussed above with respect to filter calculator 636. In some embodiments, audio processing application 532 determines the set of filters based on one or more properties of the selected subset of speakers and one or more target characteristics associated with the acoustic system. The one or more target characteristics could include, for example, crosstalk cancellation or binaural audio position accuracy.

In step 710, the audio processing application 532 generates, for each speaker in the subset of speakers, a corresponding speaker signal based on the set of filters and the portion of the audio signal. In some embodiments, each speaker in the subset of speakers corresponds to one or more filters in the set of filters. Audio processing application 532 applies the one or more filters corresponding to each speaker to the portion of audio to generate a speaker signal for the speaker.

In some embodiments, audio processing application 532 transmits the speaker signals to a mixer. The mixer determines a mix ratio between the speaker signals, generated using the steps 702-710 above, and speaker signals generated using one or more other techniques. The mixer transmits the corresponding speaker signals to each speaker based on the mix ratio. Determining the mix ratio is performed in a manner similar to that described above with respect to mixer 650.

In some embodiments, the mixer determines the mix ratio based on a set of one or more heuristics and/or rules. The mixer evaluates the acoustic system and listening environment based on the set of heuristics and/or rules to generate a score corresponding to the acoustic system and the listening environment. The mixer maps the score to a specific mix ratio.

In step 712, the audio processing application 532 causes a corresponding speaker signal to be transmitted to each speaker in the subset of speakers. In some embodiments, audio processing application 532 transmits the speaker signals to a mixer. The mixer determines a mix ratio and transmits the corresponding speaker signals to each speaker based on the mix ratio. In some embodiments, audio processing application 532 transmits the corresponding speaker signal to each speaker without using a mixer.

In some embodiments, rather than transmitting the speaker signals to a mixer that determines a mix ratio between the speaker signals and other speaker signals, audio processing application 532 could determine the mix ratio between the speaker signals and other speaker signals, and transmit the corresponding speaker signal to each speaker based on the mix ratio. Audio processing application 532 could determine the mix ratio in a manner similar to that described above with respect to mixer 650.

In sum, an acoustic system includes a plurality of speakers, where each speaker is located at a different location within a listening environment. The acoustic system includes a processing unit that analyzes data associated with a portion of an input audio signal to determine a position associated with the portion of the input audio signal. The processing unit selects a subset of speakers for rendering the portion of the input audio signal based on the position associated with the portion of the input audio signal, the locations of the plurality of speakers, and the position and/or orientation of a listener within the listening environment. The processing unit determines a set of filters to apply to the portion of the input audio signal based on the subset of speakers and one or more target sound characteristics, such as crosstalk cancellation and sound position accuracy. The processing unit applies the set of filters to the portion of the input audio signal to generate speaker signals for the subset of speakers. The processing unit determines a mix ratio between using the speaker signals or using speaker signals generated using other techniques, such as amplitude panning. The processing unit transmits each speaker signal to a corresponding speaker in the subset of speakers. When played by the subset of speakers, the speaker signals cause a sound corresponding to the portion of the input audio signal to be perceived as emanating from the position associated with the portion of the input audio signal.

At least one technical advantage of the disclosed techniques relative to the prior art is that the audio system creates a three-dimensional sound experience while reducing crosstalk and other interference caused by people and/or objects within the listening environment. Furthermore, the audio system is able to adjust the three-dimensional sound experience based on the position and/or orientation of the listener, to account for changes it the position and/or orientation of the listener. Accordingly, the audio system generates a more immersive and accurate sound relative to prior approaches. These technical advantages provide one or more technological advancements over prior art approaches.

1. Various embodiments include a computer-implemented method for generating immersive audio for an acoustic system, the method comprising: determining an apparent location associated with a portion of audio; calculating, for each speaker included in a plurality of speakers of the acoustic system, a perceptual distance between the speaker and the apparent location; selecting a subset of speakers included in the plurality of speakers based on the perceptual distances between the plurality of speakers and the apparent location; generating a set of filters based on the subset of speakers and one or more target characteristics of the acoustic system; and generating, for each speaker included in the subset of speakers, a speaker signal using one or more filters included in the set of filters.

2. The method of clause 1, wherein calculating the perceptual distance between the speaker and the apparent location is based on a set of one or more heuristics, wherein each heuristic is associated with one or more properties of a respective speaker.

3. The method of clause 1 or clause 2, wherein selecting the subset of speakers comprises selecting two or more speakers included in the plurality of speakers that have a shortest perceptual distance to the apparent location.

4. The method of any of clauses 1-3, wherein selecting the subset of speakers comprises: determining a position of a listener and an orientation of a listener; and selecting at least a first speaker positioned to a left of the listener and at least a second speaker positioned to a right of the listener, based on the position of the listener and the orientation of the listener.

5. The method of any of clauses 1-4, wherein selecting the subset of speakers comprises: determining a position of a listener and an orientation of a listener; and selecting at least a first speaker positioned in front of the listener and at least a second speaker positioned behind the listener, based on the position of the listener and the orientation of the listener.

6. The method of any of clauses 1-5, wherein calculating the perceptual distance between the speaker and the apparent location comprises: generating a plurality of nodes that includes: for each speaker included in the plurality of speakers, a first node corresponding to the speaker and a second node corresponding to the apparent location; generating a plurality of edges that connect the plurality of nodes; and calculating, for each edge included in the plurality of edges, a weight corresponding to the edge based on a first node connected to the edge and a second node connected to the edge, wherein the weight indicates a perceptual distance between the first node and the second node.

7. The method of any of clauses 1-6, wherein selecting the subset of speakers comprises: identifying a subset of nodes included in the plurality of nodes that are closest to the second node, based on the plurality of weights corresponding to the plurality of edges; and selecting, for each node in the subset of nodes, the speaker corresponding to the node.

8. The method of any of clauses 1-7, wherein the one or more target characteristics include at least one of crosstalk cancellation or sound position accuracy.

9. The method of any of clauses 1-8, wherein the method is associated with a first renderer, the method further comprising: determining a mix ratio between using audio generated by the first renderer and audio generated by a second renderer; and for each speaker included in the subset of speakers, transmitting the speaker signal to the speaker based on the mix ratio.

10. The method of any of clauses 1-9, wherein determining the mix ratio is based on a set of one or more heuristics, wherein each heuristic is associated with one or more properties of the acoustic system.

11. The method of any of clauses 1-10, wherein the first renderer utilizes binaural audio rendering and the second renderer utilizes amplitude panning.

12. The method of any of clauses 1-11, wherein: generating the speaker signal comprises receiving a binaural room impulse response (BRIR) selection; and generating the speaker signal is based on the BRIR selection.

13. Various embodiments include one or more non-transitory computer-readable media storing instructions that, when executed by one or more processors, cause the one or more processors to perform the steps of: determining an apparent location associated with a portion of audio; calculating, for each speaker included in a plurality of speakers of an acoustic system, a perceptual distance between the speaker and the apparent location; selecting a subset of speakers included in the plurality of speakers based on the perceptual distances between the plurality of speakers and the apparent location; generating a set of filters based on the subset of speakers and one or more target characteristics of the acoustic system; and generating, for each speaker included in the subset of speakers, a speaker signal using one or more filters included in the set of filters.

14. The one or more non-transitory computer-readable media of clause 13, wherein calculating the perceptual distance between the speaker and the apparent location is based on a set of one or more heuristics, wherein each heuristic is associated with one or more properties of a respective speaker.

15. The one or more non-transitory computer-readable media of clause 13 or clause 14, wherein selecting the subset of speakers comprises selecting two or more speakers included in the plurality of speakers that have a shortest perceptual distance to the apparent location.

16. The one or more non-transitory computer-readable media of any of clauses 13-15, wherein calculating the perceptual distance between the speaker and the apparent location comprises: generating a first feature vector corresponding to one or more features of the speaker; generating a second feature vector corresponding to one or more features of the apparent location; and calculating the perceptual distance based on a difference between the first feature vector and the second feature vector.

17. The one or more non-transitory computer-readable media of any of clauses 13-16, wherein selecting the subset of speakers comprises: generating a plurality of nodes that includes: for each speaker included in the plurality of speakers, a first node corresponding to the speaker and a second node corresponding to the apparent location; generating a plurality of edges that connect the plurality of nodes; calculating, for each edge included in the plurality of edges, a weight corresponding to the edge based on a first node connected to the edge and a second node connected to the edge; identifying a subset of nodes included in the plurality of nodes that are closest to the second node based on the plurality of weights corresponding to the plurality of edges; and selecting, for each node in the subset of nodes, the speaker corresponding to the node.

18. The one or more non-transitory computer-readable media of any of clauses 13-17, wherein the instructions, when executed by the one or more processors, further cause the one or more processors to perform steps of: determining a mix ratio between using binaural rendering and amplitude panning; and for each speaker included in the subset of speakers, transmitting the speaker signal to the speaker based on the mix ratio.

19. The one or more non-transitory computer-readable media of any of clauses 13-18, wherein determining the mix ratio is based on a set of one or more heuristics, wherein each heuristic is associated with one or more properties of the acoustic system.

20. Various embodiments include a system comprising one or more memories storing instructions; one or more processors coupled to the one or more memories and, when executing the instructions: determine an apparent location associated with a portion of audio; calculate, for each speaker included in a plurality of speakers of an acoustic system, a perceptual distance between the speaker and the apparent location; select a subset of speakers included in the plurality of speakers based on the perceptual distances between the plurality of speakers and the apparent location; generate a set of filters based on the subset of speakers and one or more target characteristics of the acoustic system; and generate, for each speaker included in the subset of speakers, a speaker signal using one or more filters included in the set of filters.

Any and all combinations of any of the claim elements recited in any of the claims and/or any elements described in this application, in any fashion, fall within the contemplated scope of the present invention and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module," a "system," or a "computer." In addition, any hardware and/or software technique, process, function, component, engine, module, or system described in the present disclosure may be implemented as a circuit or set of circuits. Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RANI), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine. The instructions, when executed via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A computer-implemented method for generating immersive audio for an acoustic system, the method comprising:

determining an apparent location associated with a portion of audio;

for each speaker included in a plurality of speakers of the acoustic system, calculating a perceptual distance between the speaker and the apparent location based on a difference between a first feature vector corresponding to one or more features of the speaker and a second feature vector corresponding to one or more features of the apparent location, wherein the first feature vector includes at least one feature not related to a physical distance between the speaker and the apparent location;

selecting a subset of speakers included in the plurality of speakers based on the perceptual distances between the plurality of speakers and the apparent location;

generating a set of filters based on the subset of speakers and one or more target characteristics of the acoustic system; and generating, for each speaker included in the subset of speakers, a speaker signal using one or more filters included in the set of filters.

2. The method of claim 1, wherein calculating the perceptual distance between the speaker and the apparent location is further based on a set of one or more heuristics, wherein each heuristic is associated with one or more properties of a respective speaker.

3. The method of claim 1, wherein selecting the subset of speakers comprises selecting two or more speakers included in the plurality of speakers that have a shortest perceptual distance to the apparent location.

4. The method of claim 1, wherein selecting the subset of speakers comprises:

determining a position of a listener and an orientation of the listener; and selecting at least a first speaker positioned to a left of the listener and at least a second speaker positioned to a right of the listener, based on the position of the listener and the orientation of the listener.

5. The method of claim 1, wherein selecting the subset of speakers comprises:

determining a position of a listener and an orientation of the listener; and selecting at least a first speaker positioned in front of the listener and at least a second speaker positioned behind the listener, based on the position of the listener and the orientation of the listener.

6. The method of claim 1, wherein calculating the perceptual distance between the speaker and the apparent location comprises:

generating a plurality of nodes that includes:

for each speaker included in the plurality of speakers, a first node corresponding to the speaker, and a second node corresponding to the apparent location;

generating a plurality of edges that connect the plurality of nodes; and calculating, for each edge included in the plurality of edges, a weight corresponding to the edge based on a feature vector for the speaker corresponding to the first node connected to the edge and a feature vector for the speaker corresponding to the second node connected to the edge, wherein the weight indicates a perceptual distance between the first node and the second node.

7. The method of claim 6, wherein selecting the subset of speakers comprises:

identifying a subset of nodes included in the plurality of nodes that are closest to the second node, based on the plurality of weights corresponding to the plurality of edges; and selecting, for each node in the subset of nodes, the speaker corresponding to the node.

8. The method of claim 1, wherein the one or more target characteristics include at least one of crosstalk cancellation or sound position accuracy.

9. The method of claim 1, wherein the method is associated with a first renderer, the method further comprising:

determining a mix ratio between using audio generated by the first renderer and audio generated by a second renderer; and for each speaker included in the subset of speakers, transmitting the speaker signal to the speaker based on the mix ratio.

10. The method of claim 9, wherein determining the mix ratio is based on a set of one or more heuristics, wherein each heuristic is associated with one or more properties of the acoustic system.

11. The method of claim 9, wherein the first renderer utilizes binaural audio rendering and the second renderer utilizes amplitude panning.

12. The method of claim 1, wherein:

generating the speaker signal comprises receiving a binaural room impulse response (BRIR) selection; and generating the speaker signal is based on the BRIR selection.

13. One or more non-transitory computer-readable media storing instructions that, when executed by one or more processors, cause the one or more processors to perform the steps of:

determining an apparent location associated with a portion of audio;

for each speaker included in a plurality of speakers of an acoustic system, calculating a perceptual distance between the speaker and the apparent location based on a difference between a first feature vector corresponding to one or more features of the speaker and a second feature vector corresponding to one or more features of the apparent location, wherein the first feature vector includes at least one feature not related to a physical distance between the speaker and the apparent location;

selecting a subset of speakers included in the plurality of speakers based on the perceptual distances between the plurality of speakers and the apparent location;

generating a set of filters based on the subset of speakers and one or more target characteristics of the acoustic system; and generating, for each speaker included in the subset of speakers, a respective speaker signal using one or more filters included in the set of filters.

14. The one or more non-transitory computer-readable media of claim 13, wherein calculating the perceptual distance between the speaker and the apparent location is based on a set of one or more heuristics, wherein each heuristic is associated with one or more properties of a respective speaker.

15. The one or more non-transitory computer-readable media of claim 13, wherein selecting the subset of speakers comprises selecting two or more speakers included in the plurality of speakers that have a shortest perceptual distance to the apparent location.

16. The one or more non-transitory computer-readable media of claim 15, wherein calculating the perceptual distance for the speaker comprises:

generating the first feature vector corresponding to one or more features of the speaker, wherein the first feature vector includes at least one value from a group consisting of:

a difference between an orientation of the speaker relative to a listener and an orientation of the apparent location relative to the listener, whether the speaker is part of a dipole group, the orientation of the speaker relative to the orientation of the listener, and the physical distance from the speaker to the listener; and generating the second feature vector corresponding to one or more features of the apparent location.

17. The one or more non-transitory computer-readable media of claim 13, wherein selecting the subset of speakers comprises:

generating a plurality of nodes that includes:

for each speaker included in the plurality of speakers, a first node corresponding to the speaker and a second node corresponding to the apparent location;

generating a plurality of edges that connect the plurality of nodes;

calculating, for each edge included in the plurality of edges, a weight corresponding to the edge based on a feature vector for the speaker corresponding to the first node connected to the edge and a feature vector for the speaker corresponding to the second node connected to the edge;

identifying a subset of nodes included in the plurality of nodes that are closest to the second node based on the plurality of weights corresponding to the plurality of edges; and selecting, for each node in the subset of nodes, the speaker corresponding to the node.

18. The one or more non-transitory computer-readable media of claim 13, wherein the instructions, when executed by the one or more processors, further cause the one or more processors to perform steps of:

determining a mix ratio between using binaural rendering and amplitude panning; and for each speaker included in the subset of speakers, transmitting the respective speaker signal to the speaker based on the mix ratio.

19. The one or more non-transitory computer-readable media of claim 18, wherein determining the mix ratio is based on a set of one or more heuristics, wherein each heuristic is associated with one or more properties of the acoustic system.

20. A system comprising:

one or more memories storing instructions;

one or more processors coupled to the one or more memories and, when executing the instructions:

determine an apparent location associated with a portion of audio;

for each speaker included in a plurality of speakers of an acoustic system, calculate a perceptual distance between the speaker and the apparent location based on a difference between a first feature vector corresponding to one or more features of the speaker and a second feature vector corresponding to one or more features of the apparent location, wherein the first feature vector includes at least one feature not related to a physical distance between the speaker and the apparent location;

select a subset of speakers included in the plurality of speakers based on the perceptual distances between the plurality of speakers and the apparent location;

generate a set of filters based on the subset of speakers and one or more target characteristics of the acoustic system; and generate, for each speaker included in the subset of speakers, a speaker signal using one or more filters included in the set of filters.

* * * * *